United States Patent [19]

Coffman

[11] Patent Number: 4,837,880

[45] Date of Patent: Jun. 13, 1989

[54] THERAPEUTIC WATERBED APPARATUS AND METHOD

[76] Inventor: Jeff Coffman, 5346 E. Royal Palm Rd., Paradise Valley, Ariz. 85253

[21] Appl. No.: 124,374

[22] Filed: Nov. 23, 1987

Related U.S. Application Data

[63] Continuation-in-part of Ser. No. 855,839, Apr. 24, 1986, abandoned.

[51] Int. Cl.[4] ..... A47C 27/08; A61H 7/00

[52] U.S. Cl. ..... 5/451; 5/453; 5/450; 128/64

[58] Field of Search ..... 5/451, 450, 453, 452; 128/64, 33, 66; 4/492, 542, 543, 544, 541

[56] References Cited

U.S. PATENT DOCUMENTS

| | | | |
|---|---|---|---|
| 1,212,479 | 1/1917 | Hall | 5/451 |
| 4,114,215 | 9/1978 | Santo | 5/422 |
| 4,225,984 | 10/1980 | Lindsey | 4/544 |
| 4,607,405 | 8/1986 | Ellis et al. | 5/451 |
| 4,635,620 | 1/1987 | Richio | 5/451 |

OTHER PUBLICATIONS

"Dream Whirl", an Ad on p. 61 of the Mar. 1985 issue of Flotation Sleep Industry magazine.

*Primary Examiner*—Alexander Grosz
*Attorney, Agent, or Firm*—Armstong, Nikaido, Marmelstein, Kubovicik & Murray

[57] ABSTRACT

An improved therapeutic waterbed apparatus and method having a waterbed mattress suitable for accommodating therein a structural member means for operably coupling thereto a plurality of water spray or ejecting means is disclosed. The water spray or ejecting means are preferably arranged inside the mattress to provided effective therapeutic or medical benefits for a user. To allow recirculating of said water through the structural member means, a motor-pump combination is operably connected thereto. Moreover, a control panel means is operably connected to headboard portion of the waterbed at an inclined fashion to allow easy access thereto as well as providing immediate control of any desired environmental features of the waterbed.

12 Claims, 3 Drawing Sheets

THERAPEUTIC WATERBED APPARATUS AND METHOD

This application is a continuation-in-part of U.S. application Ser. No. 855,839, filed Apr. 24, 1986 now abandoned.

BACKGROUND OF THE INVENTION

1. Field of the Invention

This invention relates generally to an improved therapeutic waterbed. The improved therapeutic waterbed has a structural member incorporated preferably inside a waterbed mattress suitable for operably accommodating thereon a plurality of water spray or ejecting means. The plurality of water spray or ejecting means are preferably arranged inside the mattress in a manner that would effectively provide a therapeutic benefit for a user. Moreover, the improved therapeutic waterbed apparatus and method of the present invention has operably incorporated therein a control means for controlling the features or characteristics of the water inside the mattress.

2. Description of the Relevant Art

In order to provide a medical type bed for patients, a bed has been provided, e.g., as in U.S. Pat. No. 665,243 filed Oct. 30, 1899 and issued on Jan. 1, 1901 to Adolfo Luria wherein a bed mattress is adapted to be inflated with hot water or air is disclosed. Here, the water inside the mattress may be heated by a member incorporated therein having a coiled configuration. The coiled member is connected to a water heater for circulating hot water therein. It is clear, however, that the Luria patent has no circulating water which is to be induced inside the mattress. In U.S. Pat. No. 3,085,568 filed Aug. 2, 1960 and issued on Apr. 16, 1963 to Harry Whitesell; and U.S. Pat. No. 4,120,062 filed Mar. 25, 1976 and issued on Oct. 17, 1978 to Richard P. Anderson, a mattress suitable for accommodating water therein to allow said mattress to be vibrated at desired positions, as in Whitesell, and a waterbed for allowing a pump to generate rushing water therein, as in Anderson (see also U.S. Pat. No. 773,828 filed on Aug. 20, 1902 and issued on Nov. 1, 1904 to John and William Titus). In either Whitesell or Anderson or Titus, however, no means are disclosed for specifically circulating water to particularly direct generated water pressure onto desired bodily areas of a user. In U.S. Pat. No. 4,114,215 filed July 11, 1977 and issued on Sept. 19, 1978 to Philip J. Santo, an accessory control for a waterbed for controlling certain accessories like a pump filling or emptying the waterbed, a vibrator, a sound system and a mechanism to control the environment of the room in which the waterbed is located. Here, however, no control means are provided for controlling a plurality of spray or ejecting means therethroughout the waterbed mattress as in Applicant'invention.

A dire was therefore felt to provide an improved therapeutic waterbed having a plurality of water spray or ejecting means suitable for specifically located in desired areas for therapeutic benefits for a user.

It is therefore an object of the present invention to provide an improved therapeutic waterbed suitable for having a mattress capable of accommodating therein a structural member with a plurality of spray or ejecting means directed to desired locations for purposes of therapeutically or medically benefitting a user.

It is another object of the present invention to provide a an improved therapeutic waterbed suitable for having water recirculating pump in conjunction with a motor for operating said plurality of spray or ejecting means.

It is still another object of the present invention to provide an improved therapeutic waterbed suitable for having a control means for manipulating desired features of the waterbed environment.

It is a further object of the present invention to provide an improved therapeutic waterbed which can be easily and economically produced, yet sturdy in construction and highly efficient in operation.

It is still a further object of the present invention to provide an improved therapeutic waterbed which is constructed with extreme simplicity, embodying simple parts, yet highly efficient in operation and capable of being retailed for a low price, long-lasting in use, and convenient to handle.

SUMMARY OF THE INVENTION

The aforementioned and other objects of the present invention are accomplished by providing an improved therapeutic waterbed apparatus and method embodying a structural member means incorporated preferably inside a waterbed mattress suitable for accommodating thereon a plurality of water spray or ejecting means which are preferably arranged inside the mattress in a manner that would effectively provide therapeutic or medical benefits for a user. Further, the improved therapeutic waterbed apparatus and method of the present invention is operable coupled to a water recirculating pump and motor, as well as a control means for controlling the features or characteristics of the water inside the mattress.

These and other features of the invention will be understood upon reading of the following description along with the drawings.

DETAILED DESCRIPTION OF THE PREFERRED EMBODIMENTS

Figure 1:
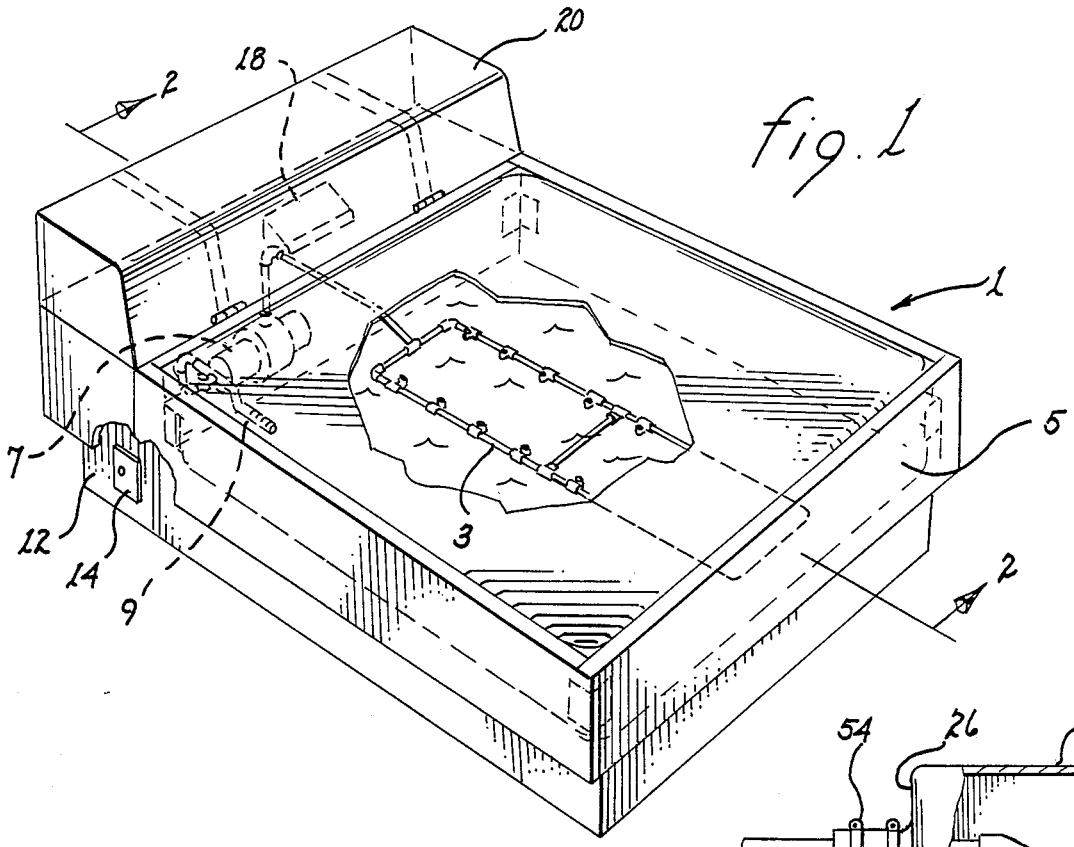
FIG. 1 is a perspective view of an improved therapeutic waterbed in accordance with the present invention showing the manner in which a structural member for spraying or ejecting water is accommodated inside a waterbed mattress and an associated control panel means incorporated into a waterbed backboard.

FIG. 1 is a perspective view of the improved therapeutic waterbed, generally referred to by reference number 1, of the present invention showing a piping structural member 3 incorporated inside a waterbed mattress 5. Here, the piping structural member 3 is operably connected to a motor-pump combination 7, preferably electrically operated and thereafter operably connected to a suction-type apparatus 9. The base portion 12 of the waterbed 1 preferably has a door panel member 14 to permit removal of drained water 16 (see FIG. 2, infra). A control panel means 18, preferably of a touch-tone type, is operably coupled within a headboard portion 20 of the waterbed 1. The control panel means 18 is preferably mounted at an angular position (see also FIG. 2, infra) to allow easy access by a user to the touch-tone portions thereof. The control panel means 18 can, for example, a timer for the motor-pump combination 7 for controlling the length of the operation thereof, the temperature of the water inside the mattress 5, a reset of the above-mentioned control features or the like.

Figure 2:
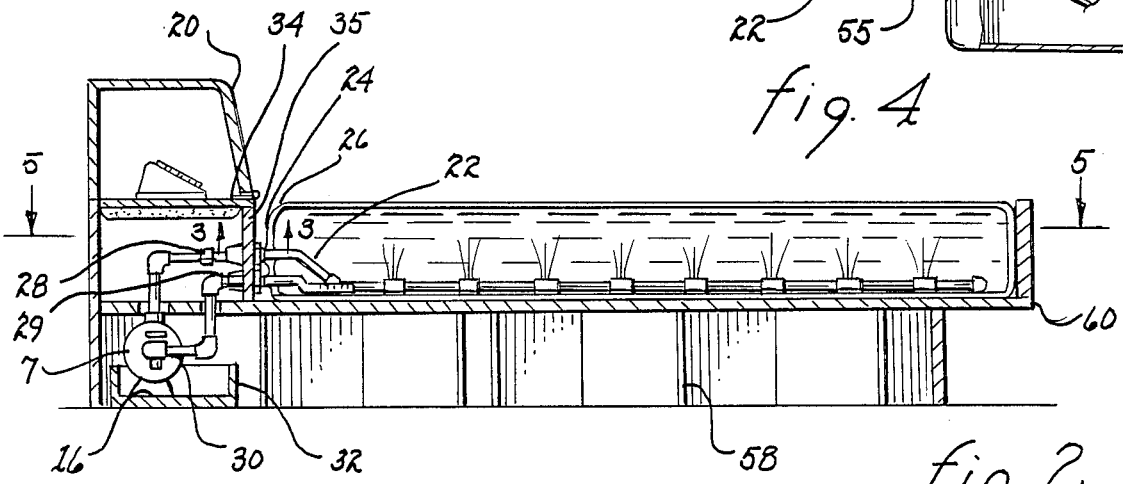
FIG. 2 is an elevational view of the improved therapeutic waterbed showing the manner in which the water spraying or ejecting structural member is laid down inside the waterbed mattress as well as being operably connected to an associated recirculating pump.
Figure 3:
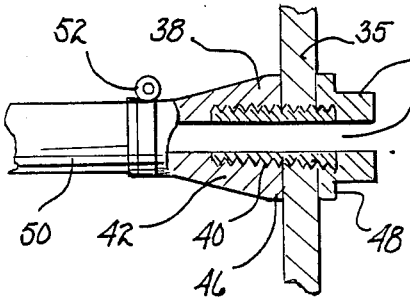
FIG. 3 is a cross-sectional view taken along line 3—3 of FIG. 2 showing the manner in which pipe means pass therethrough a back member abutting the back portion of the waterbed mattress.

As shown in FIG. 2, the piping structural member 3 is laid down onto the inner bottom surface of the mattress 5 while a connecting pipe portion 22 thereof upwardly inclines, as shown, in order to pass therethrough an aperture 24 through the back portion 26 of the mattress 5 (see also FIG. 3, infra). To permit easy and rapid assembling and disassembling of the piping structural member 3 to the motor-pump combination 7, a first conventional union fitting pipe member 28 is removably connected therebetween, as illustrated in FIG. 2.

As further illustrated in FIG. 2, the motor-pump combination 7 has a conventional bib member 30 for water draining purposes. Therebelow the bib member 30 is a drip pan member 32 for retaining the water 16 therein which may accumulate due to water leak which may occur from the bib member 30, motor-pump combination 7, pipes connecting thereto, or the like. In order to minimize and efficiently reduce the noise originating from the motor-pump combination 7 therebelow the headboard portion 20 of the waterbed 1, a soundproof member 34 is integrally coupled therebelow.

In FIG. 3, abutting the back portion 26 of the mattress 5, is a safety seal member 38 having an intermediate portion 35 of the headboard 20 therebetween in order to seal off connecting tubes therebetween the intermediate portion 35 and the mattress 5. Here, the safety seal member 38 comprises a threaded portion 40, preferably made out of plastic, as well as a first 42 and second 44 portions which are both preferably made out of rubber. The threaded portion 40 is integrally connected to the second portion 44 of the safety seal member 38. Both the first 42 and second 44 portions of the safety seal member 38 have flanges 46, 48, respectively; also, preferably made out of rubber. The first portion 42 of the safety seal member 38 is coupled to an exiting pipe 50 removably connected thereto by a clamping device 52. The exiting pipe 50 is thereafter operably coupled to the motor-pump combination 7. The exiting pipe 50 is thereafter connected to the union fitting pipe member 28, as illustrated in FIG. 2. The second portion 44 of the safety seal member 38 has an elongated aperture 45 for accommodating therein the connecting pipe portion 22 and at least on clamping device (see FIG. 4, infra), as well as an externally extending portion 55 of the mattress 5 (see FIG. 4, infra). Thus, the safety seal member 38 is suitable for sealing water which may leak from the mattress 5 and remain inside the liner (not shown) therethroughout the mattress 5.

Figure 4:
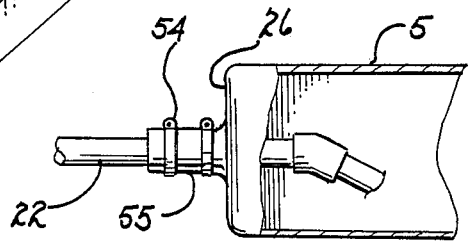
FIG. 4 is a partial cross-sectional view taken along line 4—4 of FIG. 5 showing the manner in which pipe means pass therethrough the back portion of the waterbed mattress.

As illustrated in FIG. 4, the connecting pipe 22 passes through the back portion 26 of the mattress 5 and held thereto by the at least one clamping device 54. The back portion 26 of the mattress 5 preferably has the externally extending portion 55 integral thereto for removably joining to the back portion 26 of the mattress 5.

Figure 5:
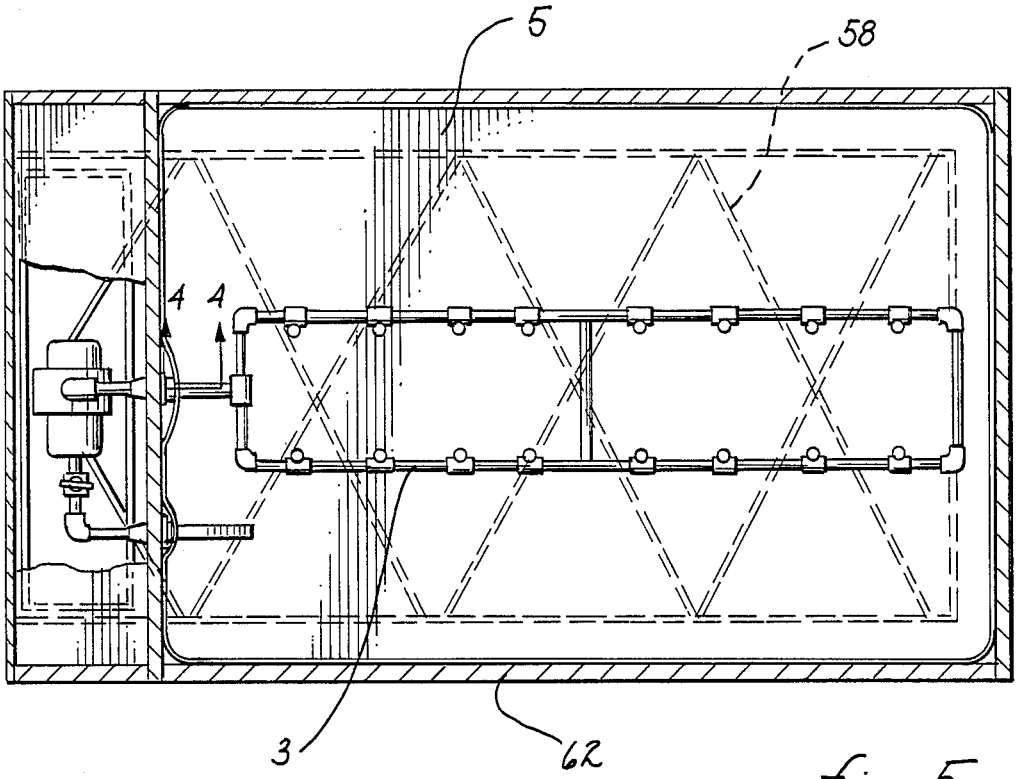
FIG. 5 is a cross-sectional view taken along line 5—5 of FIG. 2 showing the manner in which a plurality of bottom support frame members are located therebelow the mattress.

In FIG. 5, a plurality of conventional bottom support frame members 58 (see also FIG. 2, supra) are shown to be located therebelow the mattress 5, preferably in a crisscross type pattern. In FIG. 2, supra, the bottom support frame members 58 directly abuts an elongated member 60 therebetween the mattress 5 and the bottom support frame members 58. As in a conventional waterbed, surrounding support member 62 is mounted therearound the mattress 5.

Figure 6:
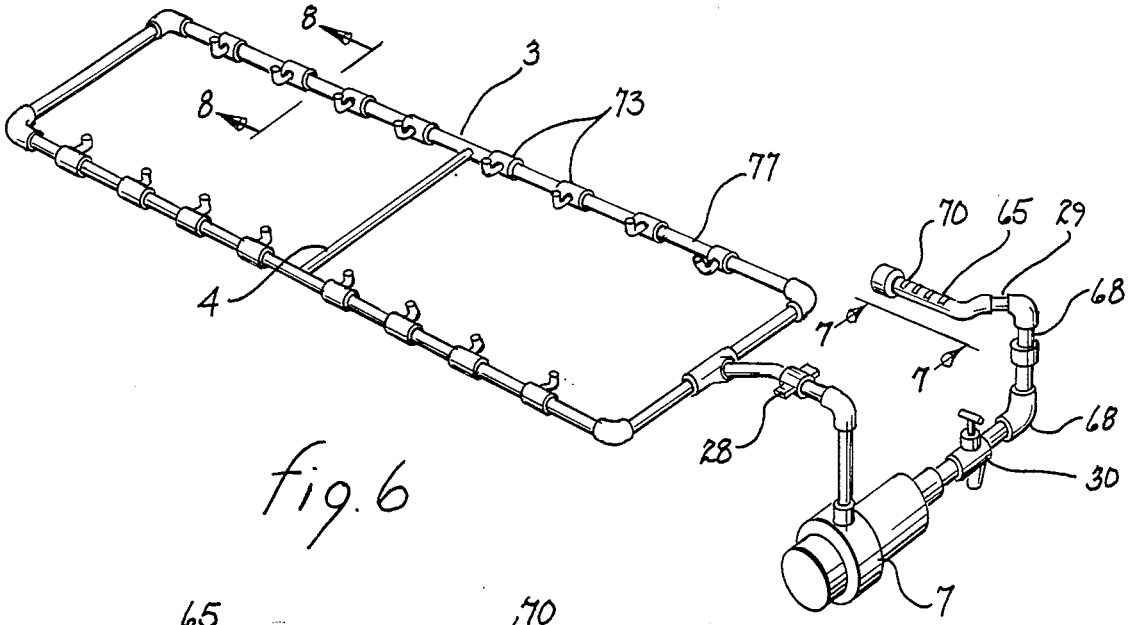
FIG. 6 is a perspective view of the structural member which operably connects a plurality of the water spraying or ejecting means.
Figure 7:
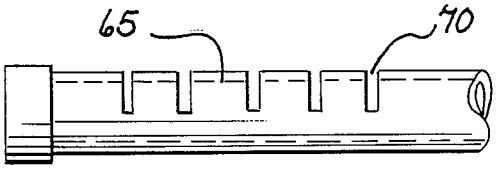
FIG. 7 is a partial side elevational view taken along line 7—7 of FIG. 6 showing the suction portion of the structural member.

The piping structural member 3 is shown in FIG. 6. Here, a suction member 65 is operably joined to the motor-pump combination 7 having the bib member 30 located therebetween. Conventional joint piping members 68 are used for coupling as clearly illustrated in FIG. 6. Therebetween the piping structural member 3 and the motor-pump combination 7 is another conventional union fitting pipe member 29. The suction member 65 has a plurality of cuts or recesses 70 (see FIG. 7, infra) passing partially therethrough to permit water from inside the mattress to be accommodated therethrough. The suction member 65 angularly protrudes downward to allow the recesses 70 thereof to be on a substantial elevation as the piping structural member 7 when said suction member 65 is in use. Removably and adjustably coupled to the piping structural member 3 are water spray or jet members 73 arranged in desired manners so that the water exiting from the spray or jet members 73 are directed to desired bodily portions of a user. The piping structural member 3 preferably has a support member 4 coupled thereto preferably at the center portion thereof to provide support to the piping structural member 3 when in use.

The improved therapeutic waterbed 1 of the present invention is suitable of having water inside the mattress 5 enter the suction member 65 by way of the recesses therein 70 then exit out through the spray or jet members 73; thus, ejecting water therefrom onto desired bodily portions of a user and recirculating water inside the mattress 5.

Figure 8:
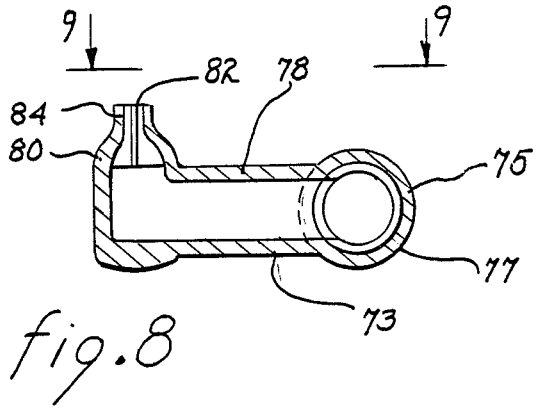
FIG. 8 is a cross-sectional view taken along line 8—8 of FIG. 6 of a water spraying or ejecting means.
Figure 9:
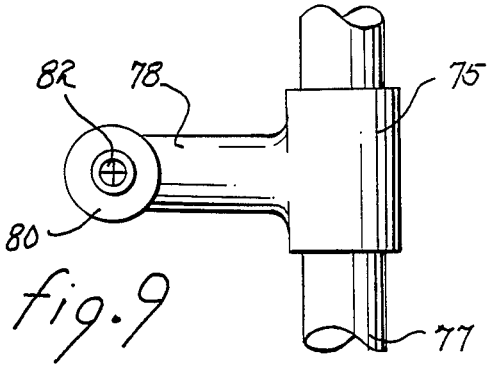
FIG. 9 is a top elevational view taken along line 9—9 of FIG. 8 showing the manner in which the spraying or ejecting means is connected to the structural member.

As more particularly illustrated in FIG. 8, the water spray or jet member 73 has an attaching portion 75 suitable for connecting to a side portion 77 (see also FIG. 6, supra). The water spray or jet member 73 also has an extending portion 78 which further connects to a spout portion 80 with an aperture 82 passing therethrough the top portion 84 thereof. FIG. 9 is another view of the same water spray or jet member 73 illustrating therein the attaching portion 75, the extending portion 78 and the spout portion 80 thereof. The plurality of water spray or jet members 73 are preferably made out of plastic, such as PVC or the like.

Figure 10A:
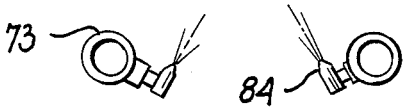
FIGS. 10A through 10D are schematic views of the manner in which the spraying or ejecting means are positioned to achieve desired locations of the water being sprayed or ejected therefrom.
Figure 10B:
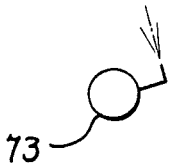
Figure 10C:
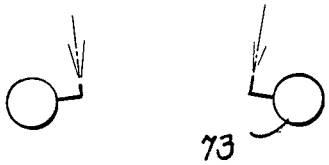
Figure 10D:
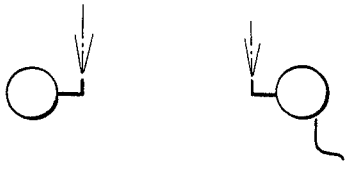

As further illustrated in FIGS. 10A through 10D, the plurality of spray or jet members 73 are positioned along the side portions 77 of the piping structural member 3 having the extending portions 78 and the spout portions 80 thereof angularly positioned relative to the elevation of piping structural member 3, if desired. The water spray or jet members 73 which are more angularly mounted, as in FIG. 10A, are preferably located proximate the upper bodily part of a user, while the lesser angularly mounted, as in FIG. 10D, spray or jet members 73 are preferably located proximate the lower portions of the user's body.

The spray or jet member 73 are preferably angled and preset at various angular combinations relative to the structural member 3.

Figure 11:
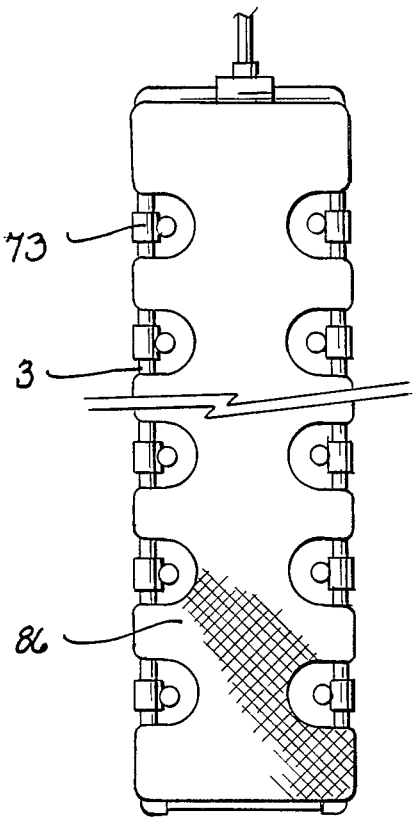
FIG. 11 is a top elevational view of the structural member having incorporated thereon a mesh-type member.

In FIG. 11, the piping structural member 3 may have an additional support member 86, such as a screen-type material having a meshed structure made out of nylon or the like which wraps around the piping structural member 3, as shown in FIG. 11, in order to support or brace the piping structural member 3 for minimizing any vibrations, or the like, when the piping structural member 3 is in use. Moreover, the additional support member 86 of meshed structure could protect the water spray or jet members 73 from being accidentally hit or dislodged in a situation where the support member 86 is used with the jet members in a structural arrangement shown in FIGS. 10*a*, 10*b*, 10*c* and 10*d*. The additional support member 86 is removably coupled to the piping structural member 3 with attaching rings (not shown) preferably made out of stainless steel or the like to preclude any rust formation thereof.

The piping structural member 3 is preferably made out of lightweight material, such as PVC or the like. The motor-pump combination 7 may those conventionally manufactured by STA-RITE Pumps Corporation of Delevan, Wisconsin. Moreover, the motor-pump combination 7 may be a $\frac{3}{4}$–1 horsepower, 110 volt unit if between 6–8 spray or jet members 73 are employed. If between 8–12 spray or jet members 73 are used, a 1–1.5 horsepower, 110 volt motor-pump combination 7 may be employed. If at least 16 spray or jet members 73 are used, a 1.5 horsepower, 220 volt motor-pump 7 is preferable. However, the power of the motor-pump combination 7, and the voltage for operation thereof can vary either from any combination of the above-mentioned horsepower and voltage values, as well as any other combinations conventionally available for use with any other combinations of numbers of the plurality of spray or jet members 73 in use thereof.

A conventional liner (not shown) surrounds the mattress 5. Here, the liner can be of a material such as vinyl or the like to preclude any water leakage originating from the mattress 5. In order to allow the fitting of the liner therearound the mattress 5, apertures (not shown) pass therethrough for accommodating the connecting pipe member 22 and a pipe connected to the suction member 65 therein, as previously discussed. In order to secure the liner therearound the mattress 5, the apertures through said liner are secured by conventional flanges (not shown) therearound the connecting pipe member 22 and the pipe connected to the suction pipe member 65.

While the invention has been particularly shown and described in reference to preferred embodiments thereof, it will be understood by those skilled in the art that changes in form and details may be made without departing from the spirit and scope of the invention.

I claim:

1. An improved therapeutic waterbed, comprising:

a mattress means for containing water therein;

a base means for accommodating said mattress means thereabove;

a control panel means for controlling environmental features of said waterbed, said control panel means being of touch-tone type;

a head board means for accommodating therein said control panel means;

a structural member means for circulating said water contained in said mattress;

a plurality of jet means operably coupled to said structural member means for ejecting water therefrom, wherein said jet means are angularly positioned and preset relative to the structural member means, and wherein at least some of said jet means are preset at different angular positions relative to other of said jet means, wherein each of said jet means comprises a spout portion, an extending portion and an attaching portion, wherein said spout and extending portions have a common continuous aperture passing therethrough for passing and ejecting said water, and wherein said attaching means is movable and suitable for being preset relative to said structural member means;

a pump means operably coupled to said structural member means for recirculating water throughout said structural member;

a motor means operably coupled to said pump means for operating said pump means; and a suction member means operably connected to said structural member means for allowing water to enter into said structural member.

2. The improved therapeutic waterbed as in claim 1 further comprising:

a bib member means between said suction member means and said pump means for releasing water therefrom; and a tray means for accumulating water from water leakage.

3. The improved therapeutic waterbed as in claim 2 wherein said structural member means is substantially rectangular.

4. The improved therapeutic waterbed as in claim 3 wherein said water jet means comprises a holding portion means for attaching to said side portion of said structural member means; an extension portion means for extending from said connecting attaching portion; and a spout means for ejecting water therefrom.

5. The improved therapeutic waterbed as in claim 1, further comprising a support member generally made of a mesh material coupled to said structural member means.

6. The improved therapeutic waterbed as in claim 1, wherein said suction member has a plurality of recess means for passing water therethrough.

7. A method of ejecting recirculating water inside a waterbed, comprising the steps of:

providing waterbed mattress containing water therein;

providing a structural member to permit said water to recirculate throughout said mattress;

providing a pump for recirculating said water;

providing a motor for operating said pump;

allowing water inside said mattress to enter said structural member;

recirculating said water throughout said structural member; and ejecting said water from said structural member into a common continuous aperture passing through an attaching portion, an extending portion and then through a spout portion inside said mattress, wherein each attaching portion is angularly positioned and preset relative to the structural member, and wherein at least some of said water ejections are preset at different angular positions relative to other of said water ejections.

8. The method of ejecting recirculating water inside a waterbed as in claim 7, further comprising the steps of:

providing a bib member;

providing a water tray; and thereafter releasing water from said bib member.

9. The method of ejecting recirculating water inside a waterbed as in claim 7, further comprising the step of providing a control panel means for controlling desired environmental features of said waterbed.

10. The method of ejecting recirculating water inside a waterbed as in claim 7 wherein said step of ejecting water from said structural member comprises the step of adjusting each of said water ejection at a desired angular position relative to said structural member and to said other water ejections.

11. The method of ejecting recirculating water inside the waterbed as in claim 7, further comprising the step of providing a support member generally made of a mesh material coupled to said structural member.

12. The method of ejecting recirculating water inside a waterbed as in claim 7, wherein the step of allowing water inside said mattress to enter said structural member comprises the step of allowing water through a suction means having at least one recess means.

* * * * *